US006016878A

United States Patent [19]

Jansson

[11] Patent Number: 6,016,878

[45] Date of Patent: Jan. 25, 2000

[54] METHOD AND DEVICE FOR DRILLING

[75] Inventor: Kjell Jansson, Sollentuna, Sweden

[73] Assignee: Atlas Copco Craelius AB, Marsta, Sweden

[21] Appl. No.: 09/029,453

[22] PCT Filed: Aug. 27, 1996

[86] PCT No.: PCT/SE96/01052

§ 371 Date: Feb. 26, 1998

§ 102(e) Date: Feb. 26, 1998

[87] PCT Pub. No.: WO97/08428

PCT Pub. Date: Mar. 6, 1997

[30] Foreign Application Priority Data

Aug. 28, 1995 [SE] Sweden ..... 9502961

[51] Int. Cl.[7] ..... E21B 44/00; E21B 3/02

[52] U.S. Cl. ..... 175/27; 173/6

[58] Field of Search ..... 175/27, 24; 173/2, 173/4, 5, 6, 141, 152

[56] References Cited

U.S. PATENT DOCUMENTS

| | | | |
|---|---|---|---|
| 3,613,805 | 10/1971 | Lindstad et al. | 175/27 |
| 3,971,449 | 7/1976 | Nylund et al. | 175/27 |
| 4,875,530 | 10/1989 | Frink et al. | 175/27 |
| 5,318,136 | 6/1994 | Roswell et al. | 175/24 |
| 5,449,047 | 9/1995 | Schivley, Jr. | 175/27 |

*Primary Examiner*—Hoang Dang
*Attorney, Agent, or Firm*—Mark P. Stone

[57] ABSTRACT

Methods and devices are provided for drilling with impregnated diamond drill bits in which the drill bit (30) automatically continues cutting. The speed of a drilling device (3) along a feed device (2) is determined, and the measured value is used for continuously controlling the feed cylinder (10) and a flushing medium pump (29) such that a substantially constant feed rate is achieved while simultaneously maintaining the rotational speed of the drill bit (30) within predetermined limits.

2 Claims, 2 Drawing Sheets

METHOD AND DEVICE FOR DRILLING

BACKGROUND OF THE INVENTION

The present invention relates to a method and a device for drilling in rock or in earth layers with impregnated diamond drill bits, i.e. drill bits with diamonds in the bit body.

In prior art drilling devices, e.g. for exploration drilling, of the kind which the present invention intends to improve one has the problem of obtaining good drill penetration and good service life at the same time. If the feed force is too low the drill bit is polished so that it very soon loses its cutting ability. If the feed force is too high the drill bit is quickly destroyed because of overheating. The problem of the operator is to continously watch the drilling parameters and correct if the drill penetration decreases. If the drill bit starts being blunt the cutting ability can be restored through momentary increase of the feed force and/or through momentary drastic decrease of the amount of flushing fluid. Since the ability of the operator to observe decreased drill penetration is limited restoration of the cutting abillity results in a large wear of the drill bit. Furthermore the manual sharpening of the drill bit results in a great risk that the drill bit is overheated and quickly destroyed.

SUMMARY OF THE INVENTION

The present invention, which is defined in the subsequent claims, aims at achieving a drilling device where the service life of the drill bit is substantially increased at the same time as the drill penetration is a kept at a substantially constant and high level. This is achieved through sensing a number of drilling parameters and that the drilling device is automatically controlled depending on the parameters.

BRIEF DESCRIPTION OF THE DRAWINGS

An embodiment of the invention is described below with reference to the accompanying drawings in which.

DESCRIPTION OF THE BEST MODES FOR CARRYING OUT THE INVENTION

Figure 2:
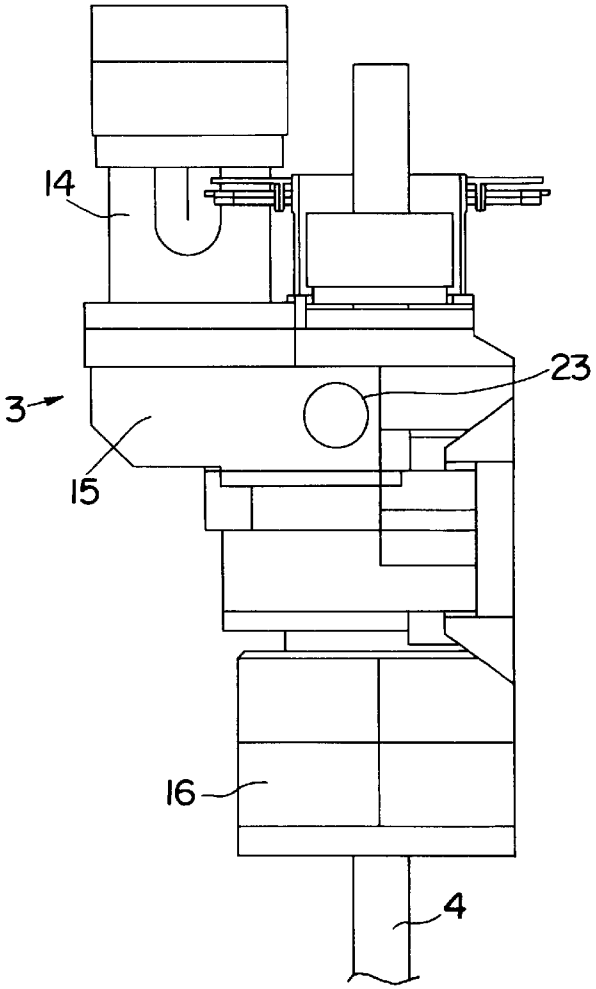
FIG. 2 shows a part of the drilling device in FIG. 1 on a larger scale.
Figure 1:
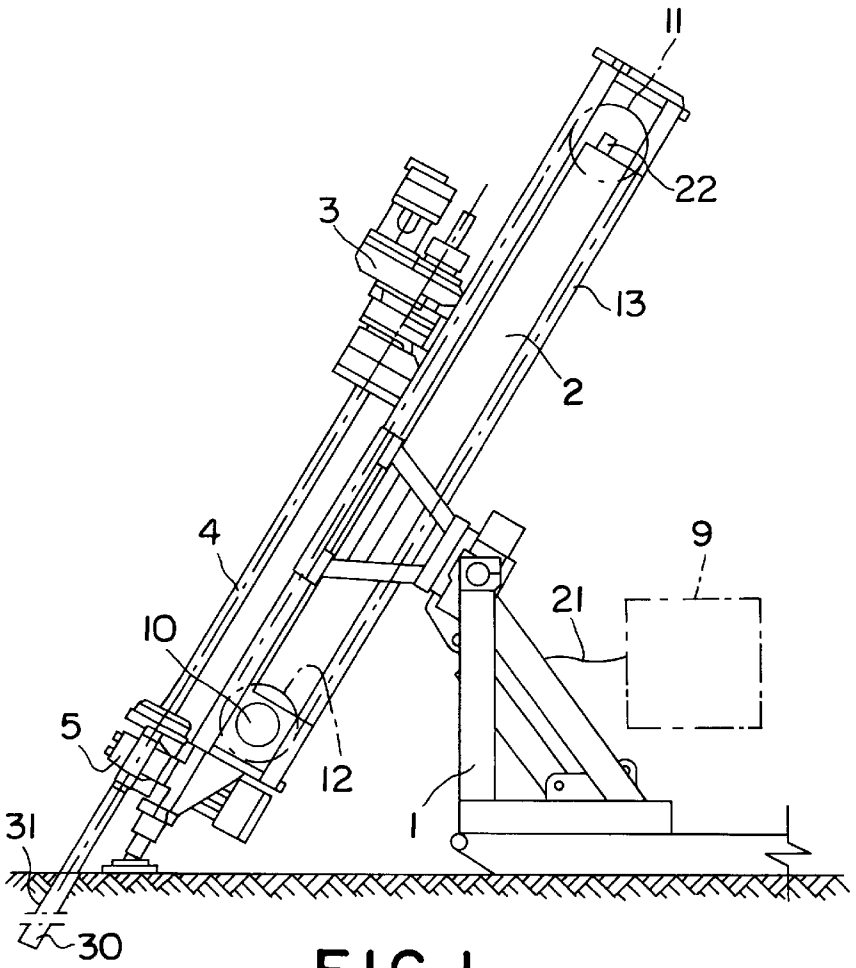
FIG. 1 shows a side view of a drilling device according to the invention.

The drilling device shown in the drawings comprises a stand 1 on which a feed device 2 is arranged. The stand can be in form of a sledge as in FIG. 1 or a vehicle or another arrangement carrying the feed device in a stable manner. The feed device 2 has in the shown example been simplified so as to comprise two sprockets 11,12 and a chain 13 which passes over the sprockets and is connected with a drilling device 3 and is driven by a motor 10 which drives the sprocket 12. The feed device can be made in an arbitrary way which allows movement of the drilling unit to-and-fro along the feed device 2. A preferred feed device is shown in U.S. Pat. No. 3,613,804, where a hydraulic cylinder is used as feed motor. The drilling device comprises a rotary motor 14 which via a gear box 15 rotates a chuck 16. The drilling device has a through passage for a drill string 4. The chuck 16 comprises gripping means which can be brought into engagement with the drill string for rotation of the drill string. A holder 5 for the drill string is arranged at the lower end of the feed device 2. Cooperation between the chuck 16, holder 5, feed device 2 and the drilling device 3 can be as described in U.S. Pat. No. 3,613,804. The feed device 2 furthermore comprises a sensor 22 for measuring the position and the speed of the drilling device 3 along the feed device. This can take place in several different ways, e.g. that the position of the drilling device is measured at given times whereby position and time is used to calculate the speed. One can also directly measure the speed or use a position sensor with built-in electronics which delivers a speed signal. The drilling device 3 is provided with a revolution sensor 23 for indication of the rotational speed of the rotary motor 14 and thus also indication if rotation is there or not. Signals from the different sensors are via cables 21 transferred to a control unit 9 for controlling the drilling process in a way which is closer described below. The control unit 9 is also used for registering the movement of the drilling device 3 along the feed device and for registering the rotation of the drilling device. In the shown example the control unit 9 comprises a computer for controlling different functions during drilling.

Figure 3:
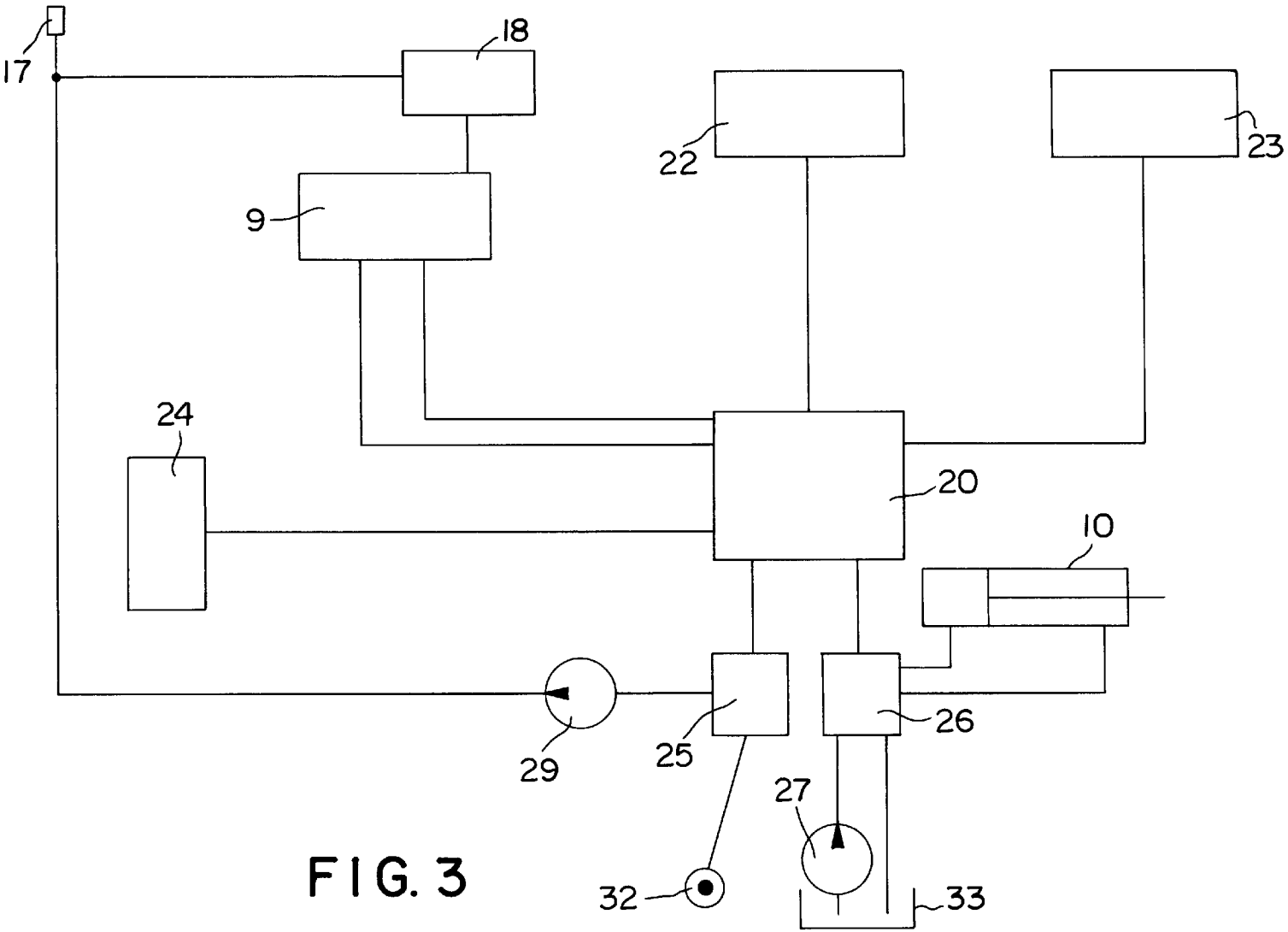
FIG. 3 shows schematically a control system comprised in the drilling device according to the invention.

In FIG. 3 it is schematically shown how the drilling is controlled. Central for the control is the control unit 9. The control unit comprises a microprocessor and necessary memory for storing the programs and data needed for holding set, predetermined, parameter values and measured values. The control unit is used for comparing set values with measured values and for controlling the equipment in dependence on the result of the comparison. For easy connection of the different units the connection box 20 is used. The control unit 9 is via the connection box connected with the revolution sensor 23. The control unit 9 is furthermore via the connection box 20 connected with two electrically controlled proportional valves 25,26. The proportional valve 25 controls the speed of the flushing medium pump 29 which delivers flushing medium from a flushing medium source 32 to a flushing head 17 connected to the top of the drill string 4. The flushing medium pressure is measured by a pressure sensor 18 which delivers a signal to the control unit 9. The proportional valve 26 controls the hydraulic pressure to the feed cylinder 10 acting as feed motor. Liquid is conducted from a tank 33 and a pump 27 to the proportional valve 26. The electric units are supplied with electricity from a power supply unit 24.

The control of the drilling process works in the following way. Desired values of penetration rate and rotation rate are stored in the control unit 9. These values are determined with respect to ground conditions and drill bit used. During the drilling penetration rate and rotation speed are measured, continuously or at determined time intervals. The measured values, or values calculated therefrom, are compared with the set, predetermined, values. If the penetration rate is lower than the desired the feed force is increased automatically by the control unit 9 controlling the proportional valve such that the pressure to the feed cylinder 10 is increased and the friction between the drill bit 30 and the rock 31 is increased, which sharpens the drill bit.

If the available feed force is insufficient to keep the drill bit sharp the control unit 9 decreases the excitation of the proportional valve 26 which decreases the amount of flushing medium from the flushing medium pump 29, which further increases the friction between the drill bit and the rock and sharpens the drill bit.

Furthermore the rotary speed is checked with the revolution sensor 23 so that the drill bit is not damaged. If the rotary speed decreases below a certain limit, because of too large friction which damages the drill bit, the control unit 9 increases the flushing medium amount back to normal amount.

Examples of suitable parameter values at drilling with a 48 mm impregnated drill bit in granite is 20 cm/min constant penetration rate and 1500 rpm rotary speed. The feed force on the drill bit then normally varies between 5 and 10 kN for keeping the drill bit sharp. If the maximum feed force on the drill bit 20 kN is not sufficient for keeping the drill bit sharp the normal flushing medium flow 20 l/min is decreased to 10 l/min for sharpening the drill bit. Should the rotational speed decrease below 1200 rpm during the sharpening process it means that the drill bit is beginning to get damaged, why the flushing medium flow is increased to 20 l/min.

I claim:

1. A method for controlling the sharpness and penetration of a drill bit for automatically keeping a drill bit cutting when drilling with an impregnated diamond drill bit, said method comprising the steps of:

measuring at least one of the position and speed of a drilling device (3) along a feed device (2) for determining a measured speed; and continuously controlling a feed motor (10) exerting a feed force on said impregnated diamond drill bit (30) and a flushing medium pump (29) supplying flushing medium to said impregnated drill bit (30) by said measured speed such that a substantially constant speed of said drilling device (3) along said feed device (2) is maintained at the same time as a rotational speed of a rotary motor (14) rotating said impregnated diamond drill bit is maintained within predetermined limits.

2. A device for controlling the sharpness and penetration of a drill bit for automatically keeping a drill bit cutting when drilling with an impregnated diamond drill bit, said device comprising a drilling device (3) movable to-and-fro along a feed device (2), a rotary motor (14) for rotating an impregnated diamond drill bit (30), and a feed motor (10) for exerting a feed force on said impregnated diamond drill bit (30); said device further including a sensor (22) for sensing at least one of the position and speed of said drilling device (3) along said feed device (2), means (23) for sensing the rotational speed of said rotary motor (14), a control unit (9) for continuously controlling a feed motor (10) and a flushing medium pump (29) supplying flushing medium to said impregnated diamond drill bit (30) such that said drilling device (3) is movable along said feed device (2) at a substantially constant speed at the same time that said rotary motor (14) has a rotational speed within predetermined limits.

* * * * *